United States Patent [19]

Gonzalez et al.

[11] 4,288,223

[45] Sep. 8, 1981

[54] TUBULAR DUCT FOR A SHIP PROPELLER

[75] Inventors: Ramón R. González; Gonzalo P. Gómez, both of Madrid, Spain

[73] Assignee: Astilleros Espanoles, S.A., Madrid, Spain

[21] Appl. No.: 119,609

[22] Filed: Feb. 8, 1980

[30] Foreign Application Priority Data

Nov. 2, 1979 [ES] Spain ..... 485.667

[51] Int. Cl.[3] ..... B63H 1/14; B63H 5/06

[52] U.S. Cl. ..... 440/71; 440/67; 440/66; 440/47; 416/236 A; 416/189

[58] Field of Search ..... 416/234, 236 A, 189, 416/247 A; 415/182; 115/34 R, 34 B, 40, 39, 42; 440/67, 71, 66, 47

[56] References Cited

U.S. PATENT DOCUMENTS

| | | | |
|---|---|---|---|
| 28,688 | 6/1860 | Porter | 416/236 A |
| 170,937 | 12/1875 | Cook | 416/236 A |
| 427,983 | 5/1890 | Gouilly | 115/42 |
| 652,123 | 6/1900 | Lavigne | 416/236 A |
| 675,477 | 6/1901 | Hall | 416/236 A |
| 695,389 | 3/1902 | Hammond | 416/234 |
| 1,065,089 | 6/1913 | Wabo | 115/42 |
| 2,030,375 | 2/1936 | Kort | 115/42 |
| 3,499,412 | 3/1970 | Anthes | 115/42 |
| 3,508,517 | 4/1970 | Hannan | 115/42 |
| 3,635,186 | 1/1972 | German | 115/42 |

FOREIGN PATENT DOCUMENTS

| | | | |
|---|---|---|---|
| 883255 | 7/1949 | Fed. Rep. of Germany | 115/42 |
| 814713 | 9/1951 | Fed. Rep. of Germany | 416/236 A |
| 899180 | 12/1953 | Fed. Rep. of Germany | 416/236 A |
| 1181090 | 11/1974 | Fed. Rep. of Germany | 115/42 |
| 1167603 | 11/1958 | France | 416/236 A |
| 258376 | 9/1931 | Italy | 416/236 X |
| 692752 | 8/1965 | Italy | 440/67 |
| 16750 | of 1912 | United Kingdom | 115/42 |
| 213022 | 3/1924 | United Kingdom | 416/236 A |

OTHER PUBLICATIONS

"The Kort Nozzle"-Kort Co., pp. 1-15.

*Primary Examiner*—Trygve M. Blix
*Assistant Examiner*—D. W. Keen
*Attorney, Agent, or Firm*—Berman, Aisenberg & Platt

[57] ABSTRACT

A tubular duct is provided for ship propellers with blade tips having barrier plates extending transversely therefrom. The tubular ducts are effectively arranged to extend the barrier plates in a manner which, in operation, directs a fluid stream in substantially shock-free contact with such plates.

12 Claims, 4 Drawing Figures

TUBULAR DUCT FOR A SHIP PROPELLER

RELATED APPLICATION

This application involves and is an improvement over subject matter of a prior application of one of the present inventors, Gonzalo Perez Gomez. The entire disclosure of that prior application, Ser. No. 757,492, filed Jan. 7, 1977, and now abandoned, is incorporated herein by reference.

THE TECHNICAL FIELD

The efficiency of propelling ships with propellers having finite circulation (or loading) values in their blade tips is improved by combining additional structure with such propellers.

BACKGROUND ART

The following techniques may be employed to impart finite circulation (or loading) values to blade tips of marine propellers used to power ships:

(a) having the propellers operate inside a nozzle or in any closed duct having a circular cross section which is coaxial with the propeller, and (b) adding closing plates to the tip sections of the propeller blades in a manner similar to that described in such U.S. patents as No. 28,688 (Porter), No. 170,937 (Cook), No. 652,123 (Lavigne), No. 675,477 (Hall) and No. 695,389 (Hammond).

The noted closing plates can be linked to form a concentric ring with the propeller.

STATEMENT OF THE INVENTION

Even when propeller blades are properly designed with transverse plates extending from the tips of the propeller blades so that, from a theoretical viewpoint, finite circulation (or loading) values are obtained at the tip sections of the propeller blades, such circulation (or loading) is not actually attained in practice because of the flow-separation phenomenon produced when fluid contacts the plates on the tip sections of the propeller while the propeller is driving a ship. Consequently, the performance of this type of propeller is often unsatisfactory.

The propulsive efficiency of ships having propellers of this type is considerably improved when the fluid stream contacts the plates under shock-free conditions regardless of the ship's speed and the revolution rate of the propeller. An object of the invention is to provide suitable means to create such shock-free conditions in actual practice.

DETAILED DESCRIPTION

In order to make sure that finite circulation (or loading) is attained in practice at the blade tips, and also to eliminate or substantially reduce vibration resulting from the impact of a fluid stream against closing or barrier plates of a ship screw having blades with substantially transverse projections (barrier plates) from the blade tips, a non-rotating tubular duct is placed forward (upstream) of the propeller. The after (downstream) end of the tubular duct has a circular section which is specifically adapted to the propeller. The purpose of the tubular duct is to direct fluid (passing therethrough) as smoothly as possible to the closing or barrier plates at the tip sections of the propeller. The shape of the tubular duct is designed so as to constitute an effective extension of the surface generated by the closing plates while the propeller is in operation.

The tubular duct is coaxial with and displaced from the propeller. It is naturally on the back or suction side of the propeller so that it will direct toward the propeller the fluid upon which the propeller acts.

Figure 1:
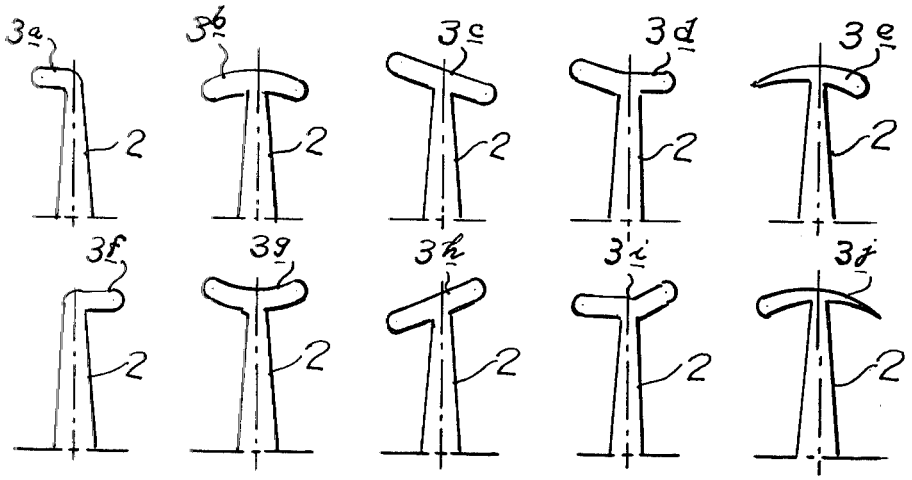
FIG. 1 presents schematic longitudinal sectional views of propeller blades having variously-shaped barrier closing plates projecting substantially transversely from the blade tips.

As the barrier or closing plates are variously designed, as shown by elements 3*a* through 3*j* in FIG. 1, they generate different geometric figures on propeller rotation. The barrier plates are so designed that the intersection with the barrier plates of a plane perpendicular to the axis of the propeller is in the form of arc sections of a circle or, if the barrier plates are extended, in the form of a circle.

Figure 3:
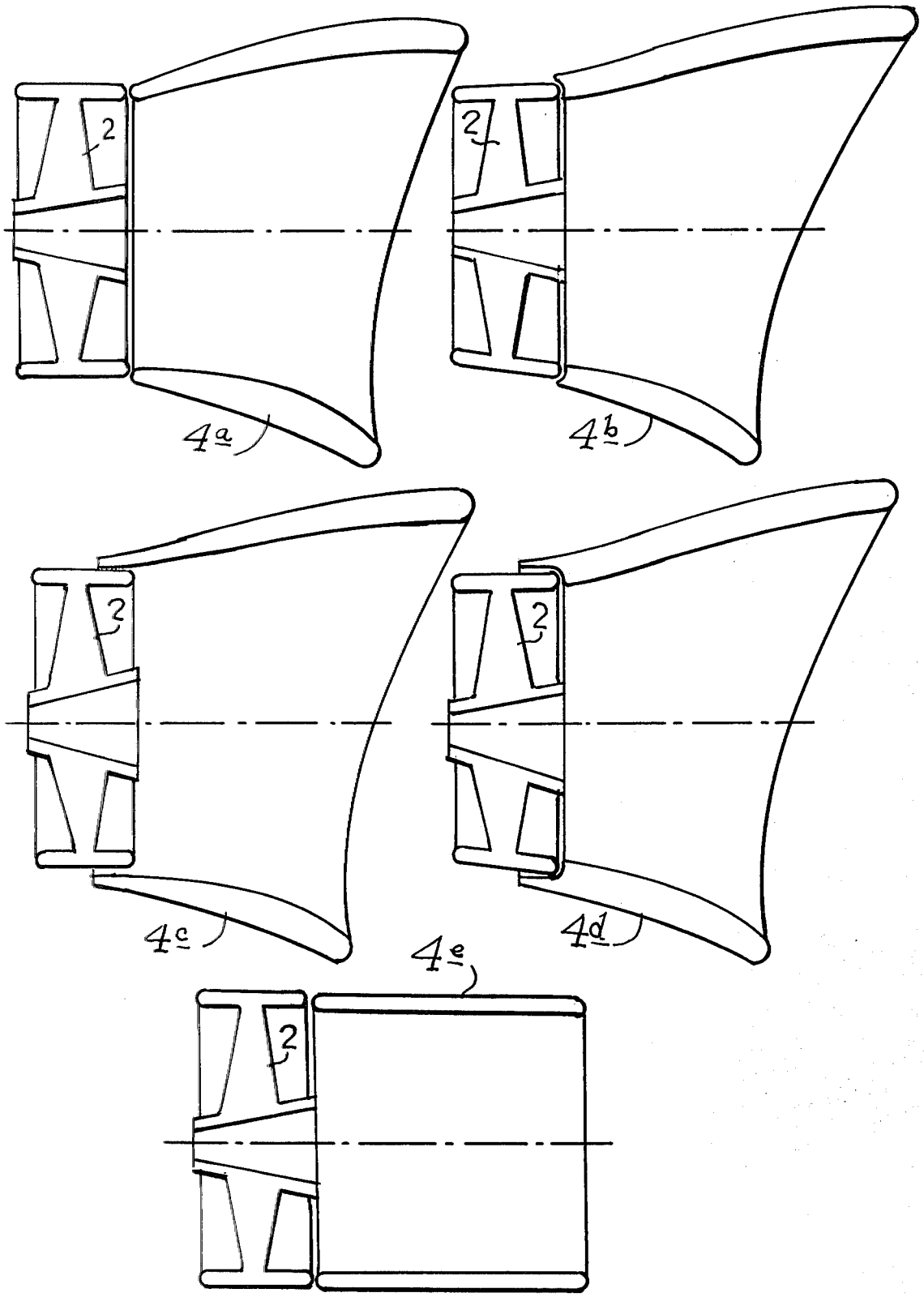
FIG. 3 provides schematic cross sections of the combination of variously-shaped tubular ducts with propellers of the type illustrated in FIGS. 1 and 2.

The actual form of the tubular duct and its precise relationship to the propeller are subject to variations in design, as shown by FIG. 3, which illustrates differently-shaped tubular ducts 4*a* through 4*e* and diverse relationships between such ducts and the propeller 2 with which they are associated.

The number of blades on a ship screw and the number of propellers used to drive a ship vary; this invention is independent of such variance. When there is only one propeller for a ship, the tubular inlet duct provided therefor must have planary symmetry with respect to the ship's longitudinal vertical center plane. The tubular duct can be uniformly-cylindrical in shape or streamlined. The more streamlined it is and the better its position with respect to streamlines of fluid in which it is immersed, the less are the disadvantages produced in towing resistance of the ship due to incorporation of the tubular duct. To obtain maximum efficiency from such duct, the distance between the forward ends of the closing or barrier plates and the after side of the duct should be as small as possible, but not less than 5 millimeters.

Figure 2:
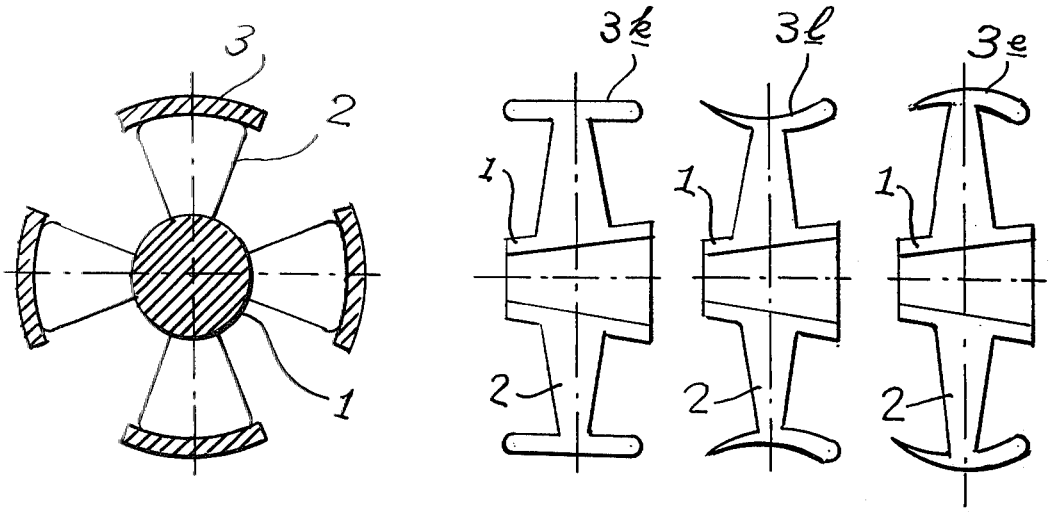
FIG. 2 presents schematic cross and longitudinal sections of propeller blades having variously-shaped closing plates at their blade tips.
Figure 4:
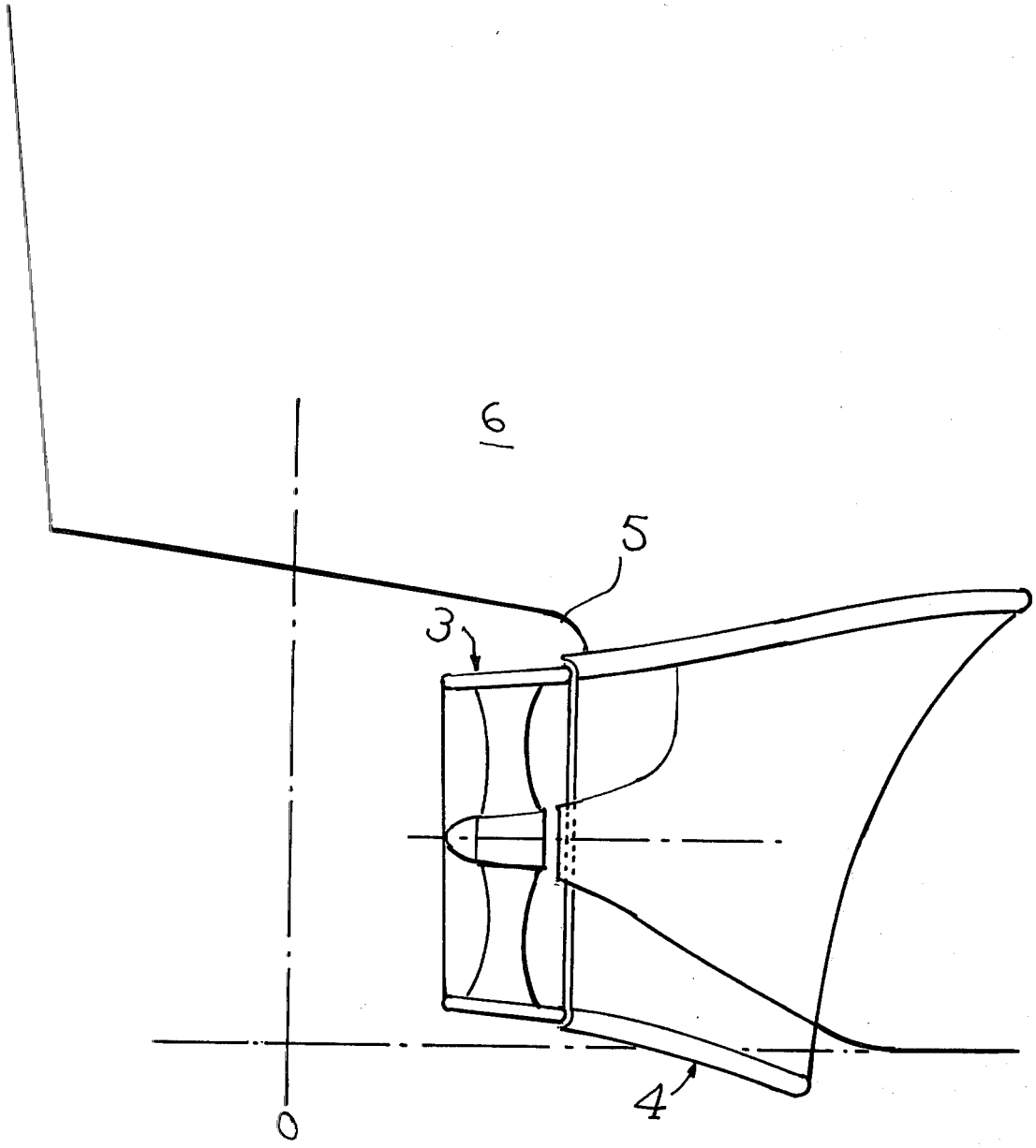
FIG. 4 is a schematic illustration of a propeller and tubular duct in its relation to a ship hull.

With reference to the figures, element 1 (FIG. 2) is a propeller hub. Element 2 (FIGS. 1 to 3) is a propeller blade. Elements 3 and 3*a* through 3*e* (FIGS. 1, 2 and 4) are closing or barrier plates. Elements 4 and 4*a* through 4*e* (FIGS. 3 and 4) are tubular ducts. Element 5 is a ship's hull. Element 6 is a ship.

The invention involves attaching a device to a ship's hull to force fluid contacting tip sections of the propeller to make such contact in parallel to the orientation of closing or barrier plates extending from such tip sections. The invention further involves increasing the propulsive efficiency of a propeller having blade tips with fixed closing plates and designed to have finite circulation (or loading) values by directing a substantially shock-free fluid stream to and past the closing plates.

INDUSTRIAL EXPLOITATION

Although tip sections of propeller blades 2 are provided with barrier plates, such as 3*a* through 3*l*, to achieve finite circulation (or loading) values at such tip sections, the desired circulation is not actually achieved. To provide suitable conditions for obtaining such circulation, a shock-free stream must be directed in contact with and past the barrier or closing plates. Such shock-free flow is achieved by providing a tubular duct, such as 4*a* through 4*e*, immediately upstream of the propeller blades. The tubular duct must be suitably adapted to the propeller design in a manner, such as that illustrated in FIG. 3.

The invention and its advantages are readily understood from the foregoing description. Various changes may be made in the process and apparatus without departing from the spirit and scope of the invention or sacrificing its material advantages. The process and apparatus hereinbefore described are merely illustrative of preferred embodiments of the invention.

What is claimed is:

1. A combination of a ship propeller in juxtaposition with a non-rotating tubular duct, the propeller having an axis, a diameter and a plurality of blades, each blade having (a) a tip radius, (b) a fixed plate and (c) a back or suction side, the tubular duct (d) being coaxial with and displaced from said propeller and on the back or suction side thereof, (e) effectively comprising means to extend a geometric figure generated (by a cross-section of an axial plane, through the tip radius of a blade, with the fixed plate) on rotation of said fixed plate about the axis, (f) having an internal radius at a point adjacent to the fixed plate which is approximately that of the geometric figure at a point which is closest to said duct, (g) providing means to direct fluid toward said back or suction side of said propeller and (h) having a length at its shortest point which is at least 20 percent and at most 2 times that of the diameter.

2. A propeller/duct combination according to claim 1 wherein the duct comprises means to direct a fluid stream in substantially shock-free contact with each fixed plate.

3. A combination according to claim 2 wherein the propeller has finite circulation (or loading) values in its blade tips.

4. A combination according to claim 3 wherein each fixed plate has a forward end and the duct has an after or downstream side, the forward end of each fixed plate being displaced by at least 5 millimeters from the after side of the duct.

5. A combination according to claim 4 wherein said forward end is as close as possible to said after side.

6. A combination according to claim 4 wherein the tubular duct has a streamlined configuration.

7. A combination according to claim 4 wherein the tubular duct has a cross-section which varies in configuration along its axis.

8. A combination according to claim 4 wherein the tubular duct has a constant length or varies in length around is periphery.

9. A combination according to claim 1 wherein the tubular duct is mounted on and fixed to a hull of a ship.

10. A combination according to claim 9 wherein the tubular duct varies in length along its periphery, its largest dimension, which may be extended forward in the form of fins, being at its highest elevation along the hull, and its shortest dimension being at its lowest elevation along the hull.

11. A ship having a hull, a propeller and a vertically longitudinal plane of symmetry passing through its center, the propeller being in a combination according to claim 1, and the tubular duct being mounted on and fixed to the hull in a manner in which it is symmetrically disposed with regard to the plane of symmetry.

12. A ship having a hull and two or more propellers, each propeller being in a combination according to claim 1.

* * * * *